United States Patent [19]

Prehodka

[11] 4,355,807

[45] Oct. 26, 1982

[54] PIVOTABLE RAMP DEVICE FOR TRACK GAMES

[75] Inventor: Barry V. Prehodka, Ridgefield, Conn.

[73] Assignee: Aurora Products Canada Limited, Mississauga, Canada

[21] Appl. No.: 227,865

[22] Filed: Jan. 23, 1981

[51] Int. Cl.[3] ..... A63F 9/14; A63H 18/16

[52] U.S. Cl. ..... 273/86 R; 46/1 K; 104/60; 273/86 B

[58] Field of Search ..... 273/86 R, 86 B; 46/1 K; 104/60, 304, 305, 54, 79

[56] References Cited

U.S. PATENT DOCUMENTS

| | | | |
|---|---|---|---|
| 3,359,920 | 12/1967 | Iammatteo | 273/86 R |
| 3,858,875 | 1/1975 | Nemeth et al. | 46/1 K X |
| 4,078,799 | 3/1978 | Lahr | 273/86 B |
| 4,185,409 | 1/1980 | Cheng | 46/1 K |

*Primary Examiner*—Anton O. Oechsle

*Attorney, Agent, or Firm*—Blum, Kaplan, Friedman, Silberman & Beran

[57] ABSTRACT

A pivotable ramp device for use in connection with track games having toy vehicles. The device includes a base which is selectively coupleable to a position along the track of the track game. The base pivotally supports a ramp at a laterally extending axis elevated above the surface of the track, the axis centrally intersecting the ramp to define two sides of the ramp. A first side of the ramp is the entrance side and a second side of the ramp is the exit side. The ramp is pivotally displaceable between a first position where the end of the entrance side contacts the track for permitting a toy vehicle traveling towards the ramp to ride up the entrance side onto the ramp and a second position where the end of the exit side contacts the track for permitting the toy vehicle thereon to ride down the ramp and back onto the track, or to permit a toy vehicle to pass under the ramp and pivotally displace the ramp out of the path of the vehicle.

16 Claims, 16 Drawing Figures

16
16c
16d
16'
17
17'
18
19
20
21
22
23
24
28
29
30
31
33
34
35
15
B
E
F
G
H
8
9A

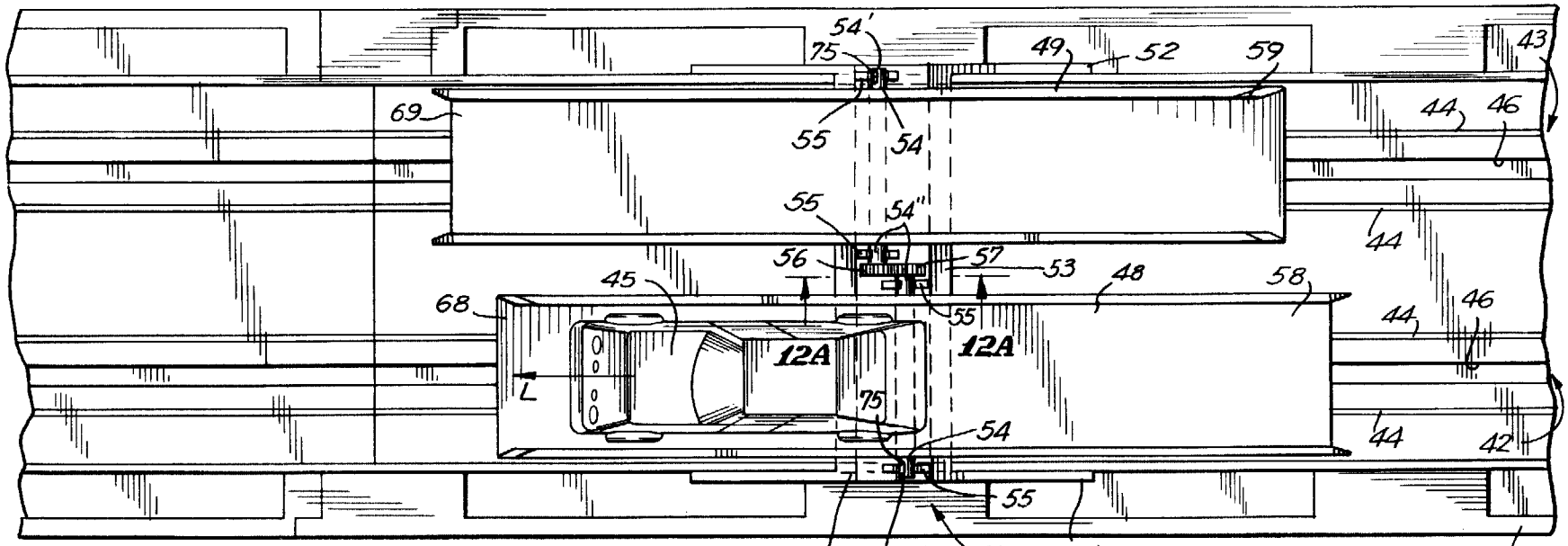
FIG. 10
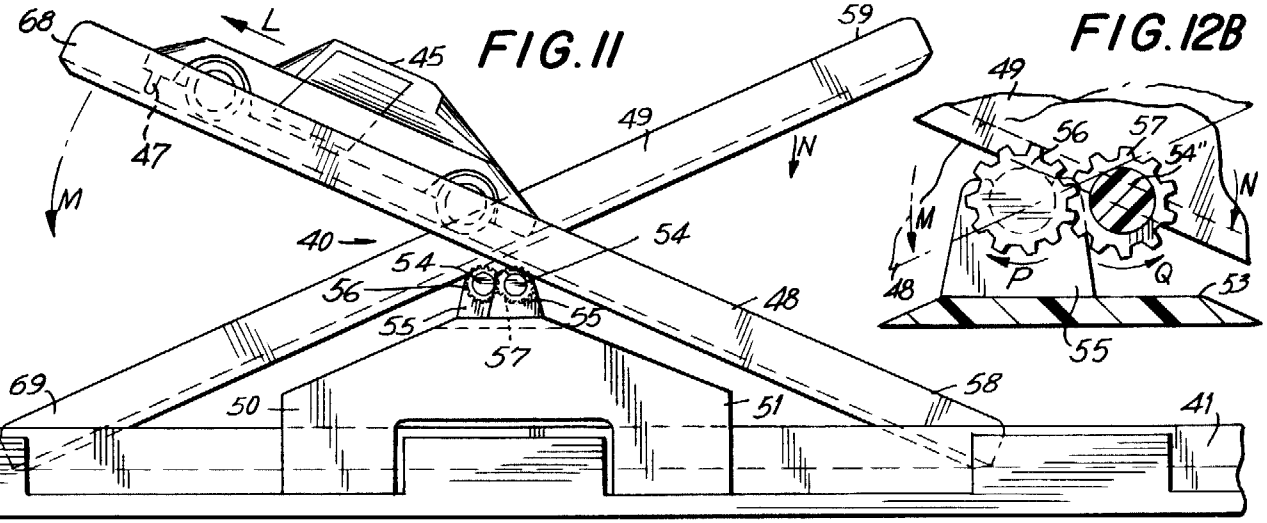
FIG. 11
FIG. 12B
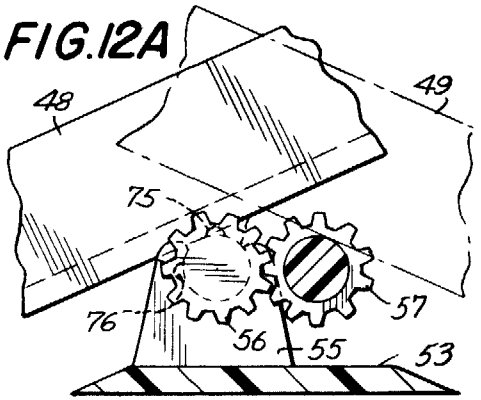
FIG. 12A

PIVOTABLE RAMP DEVICE FOR TRACK GAMES

BACKGROUND OF THE INVENTION

This invention is directed to a pivotable ramp device, and in particular, to a pivotable ramp device adapted for use in track games.

Track games have increased recognition and popularity due to their more realistic simulation of actual racing car tracks, racing cars and the like, and due to the increased control over the vehicles which has enhanced the play value of the vehicles. Early track games generally included a two lane simulated road bed or track with a slot provided in each lane of the track along the lengthwise extent thereof for guiding minature simulated racing cars and other vehicles. The toy vehicles used in connection with the slotted track include a downwardly projecting finger or rod adapted to be received in the slot on the track for guiding the vehicle around the track and for insuring the proper positioning of the vehicle on the track. Power is supplied to the toy vehicles on the track by applying a potential difference or voltage to conductors in the form of rails on the track. Contacts or brushes on the underside of the toy vehicle chasis contact the rails for supplying the voltage thereacross to a motor in the toy vehicle.

Recently, slotless tracks have been developed in which the slot in both lanes of the earlier slotted tracks has been eliminated. A slotless toy vehicle or racing car is adapted to ride around the track and is powered in a similar manner to that described above with respect to slotted toy vehicles. However, in that the slots have been eliminated from the track, the toy vehicles used in connection therewith can be caused to change lanes by providing a steering mechanism in the toy vehicle.

As toy vehicle track games have become increasingly more popular, a need has arisen for providing accessories or add-ons for the track games for increasing the skill necessary in order effectively play these games and accordingly for enhancing the play value thereof. By providing new and different features for a track game, increased skill level is required in order to play the game and competition between operators of two vehicles on a two lane track is increased. The user of the game remains interested in playing the track game and the play value of the entire track game is enhanced. Since racing car tracks and the like have provided obstacles to the racing car driver such as inclined ramps used by daredevil drivers to jump over a plurality of cars or other objects, it is desirable to provide such obstacles and ramps in present track games for providing more actual simulation of actual racing car tracks.

Accordingly, it is desired to provide a pivotable ramp device for use in connection with track games which enhances the play value of the track games and which alters the skill level required for playing a track game. By providing a pivotable ramp device which can be both ridden on and passed under depending on the orientation, alternative embodiments of which are useable in both slotted and slotless track games, the desired play value is provided.

SUMMARY OF THE INVENTION

Generally speaking, in accordance with the instant invention, a pivotable ramp device is provided for use in connection with track games. The track game includes at least a two lane track and toy vehicles for riding on the track. The pivotable ramp device includes a base which is selectively coupleable to a position along the track. The base is adapted to pivotally support a ramp at a laterally extending axis elevated above the surface of the track a height sufficient to permit passage of a toy vehicle under the ramp. The axis of pivotal mounting of the base centrally intersects the ramp to define two sides of the ramp. A first side of the ramp is an entrance side and a second side of the ramp is an exit side. The ramp is pivotally displaceable between a first position where the end of the entrance side of the ramp essentially contacts the track for permitting a toy vehicle proceeding in the direction of the entrance ramp to ride up the ramp and a second position where the end of the exit side essentially contacts the track for permitting the toy vehicle to ride down the ramp and back onto the track or to permit a toy vehicle to pass under the ramp and pivotally displace the ramp out of the path of the vehicle.

In a first embodiment, the pivotable ramp device is particularly adapted for use in connection with slotless track games and toy vehicles used in connection therewith. In this embodiment, the entrance side of the ramp extends across both lanes of the track where the track includes two lanes. The exit side of the ramp is only one lane in width so that toy vehicles exiting the ramp will feed onto one lane on the track. The ramp is normally inclined so that the entrance side of the ramp essentially contacts the track so that toy vehicles approaching the ramp will ride up onto the ramp. As a toy vehicle on the ramp rides over the axis of pivoting thereof defined by the pivotal coupling of the ramp to the base, if the toy vehicle is going at a sufficiently slow speed, the ramp will pivot so that the exit side of the ramp essentially contacts the track for allowing the toy vehicle to exit smoothly back onto the track. A detent element is provided on the pivotal coupling of the ramp to the base so that the ramp will be releasably held in the positon where the exit ramp contacts the track. In this position, a toy vehicle approaching the track in the lane on which the exit ramp contacts, will ride under the entrace side of the ramp and will contact the underside of the exit side of the ramp thereby causing the ramp to return to its original position. Alternatively, a car approaching the inverted ramp from the other lane will pass under the entrance side of the ramp and will continue unimpeded along the track. If the ramp is positioned with the entrance ramp facing the oncoming vehicle, the vehicle traversing the ramp can be driven at a speed which permits the toy vehicle to become airborne in the upward traversal of the ramp. In such a case, the detent is not engaged and the ramp returns to the original position due to the greater weight of the first side of the ramp. In this slotless variety of the pivotable ramp device, a player of the track game has the option to determine which lane to ride on, and hence, new and different strategies are made possible in a track game.

In an alternative embodiment, the pivotable ramp device is adapted for use in connection with a slotted track game and slot cars or toy vehicles used in connection therewith. In this embodiment, two ramps, one for each lane of the slotted lanes, are pivotally coupled to the base. The ramps are positioned and are interconnected by a gear mechanism or the like so that a pivoting of one of the ramps in a clockwise direction causes a pivoting of the other ramp in the opposite or counterclockwise direction. Thus, when the entrance side of the first ramp contacts the track, the exit side of the other ramp will contact the track. Hence, a vehicle approaching the first ramp in the first lane will ride up onto the exit side of the ramp and will cause the ramp to pivot when it passes over the axis of pivoting of that ramp defined by the pivotal coupling thereof to the base. This will cause the second ramp to pivot in the opposite direction so that the entrace side thereof is caused to contact the track. A vehicle approaching the entrance side of the ramp when it is raised will pass thereunder and will contact the underside of the exit side of the ramp to cause the pivoting thereof. Accordingly, utilization of this embodiment of the ramp in a slotted track game enhances the play value thereof and provides new and different strategies for playing the track game.

Accordingly, it is an object of the instant invention to provide a pivotable ramp device for use in track games.

Another object of the invention is to provide a pivotable ramp device for use in connection with track games which enhances the play value of the track game by providing obstacles and strategies not heretofore present in a track game.

A further object of the instant invention is to provide a pivotable ramp device particularly adapted for use in slotless track games.

A still further object of the instant invention is to provide a pivotable ramp device particularly adapted for use in slotted track games.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 10 is a top plan view of a pivotable ramp device constructed in accordance with a second embodiment of the invention adapted for use on a two lane slotted track;

FIG. 11 is a side elevational view of the pivotable ramp device depicted in FIG. 10;

FIG. 12A is an enlarged sectional view taken along lines 12A—12A of FIG. 10; and FIG. 12B is a view similar to FIG. 12A but depicting the two ramps in reverse orientation.

DESCRIPTION OF THE PREFERRED EMBODIMENTS

Figures 1, 2, 4A, 4B:
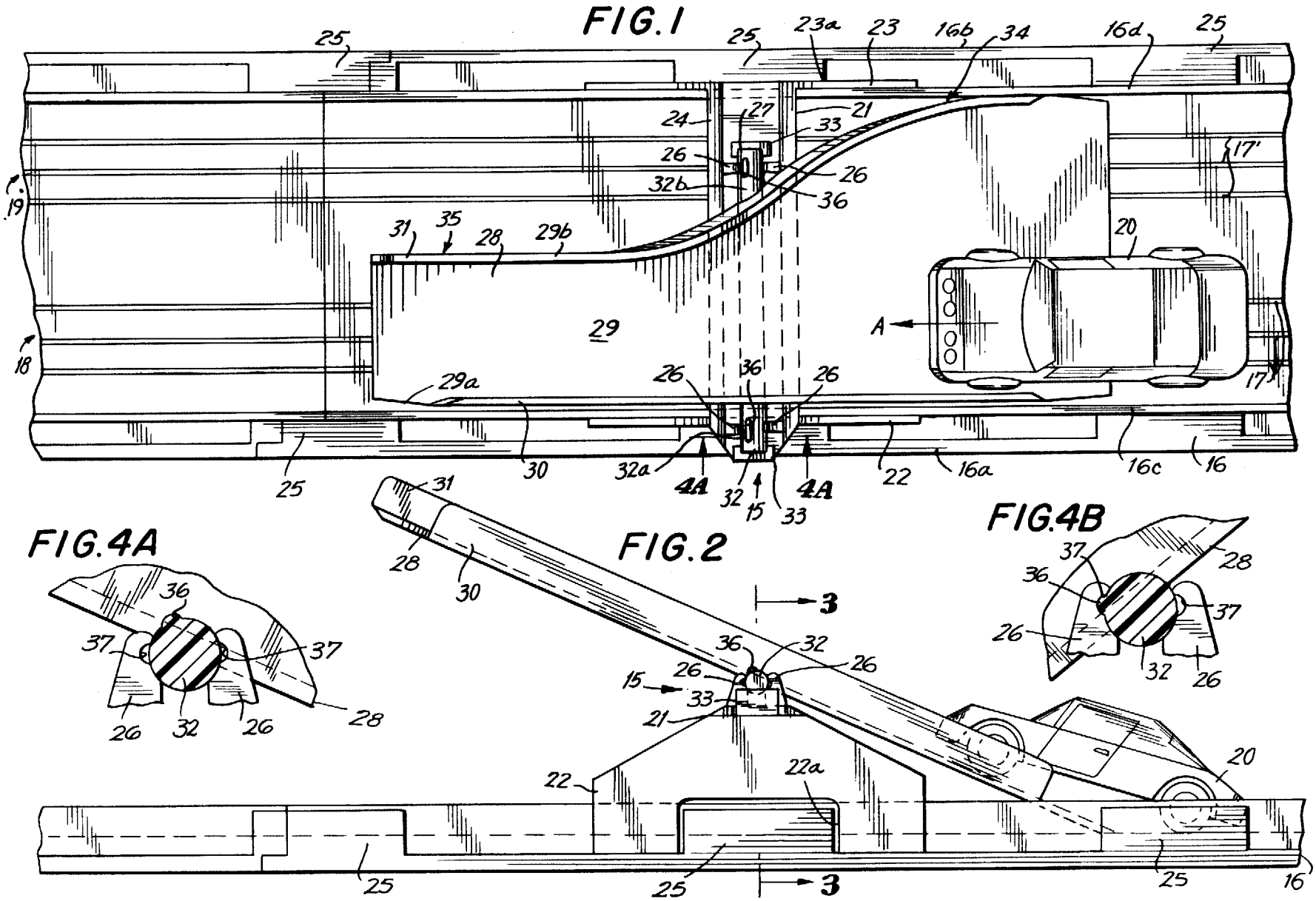
FIG. 1 is a top plan view of the pivotable ramp device constructed in accordance with a first embodiment of the invention adapted for use on a two lane slotless track.
FIG. 2 is a side elevational view of the pivotable ramp device depicted in FIG. 1.
FIG. 4A is an enlarged sectional view taken along lines 4A—4A of FIG. 1.
FIG. 4B is a view similar to FIG. 4A depicting the ramp of the pivotable ramp device after pivoting with the detent engaged.
Figures 3, 5, 6, 7, 8, 9, 9A, 9B:
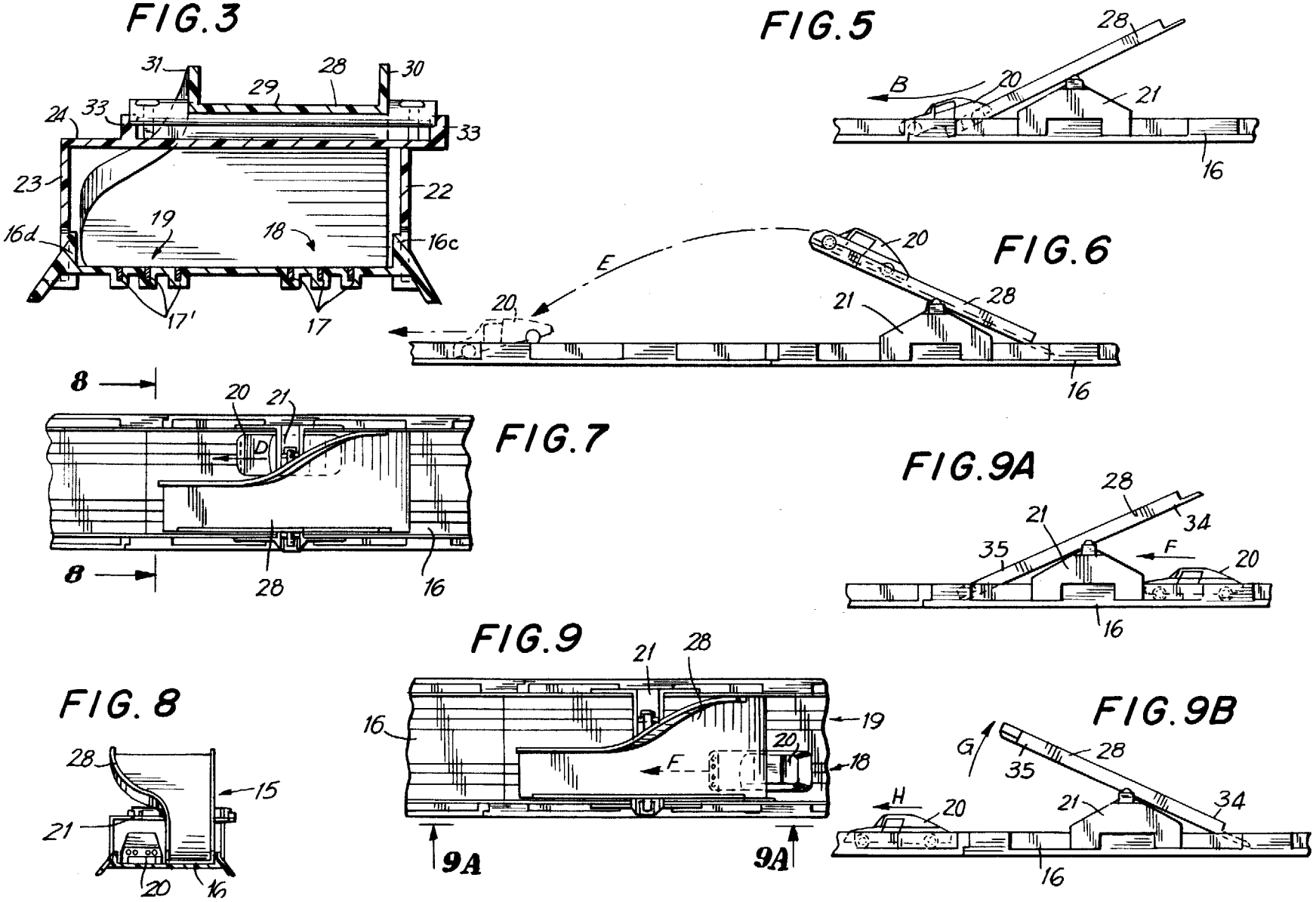
FIG. 3 is a sectional view taken along lines 3—3 of FIG. 2.
FIG. 5 is a side elevational view depicting the position of the ramp as a slow moving toy vehicle is exiting.
FIG. 6 is an elevational view depicting the position of the ramp as a fast moving toy vehicle exits and jumps off the ramp.
FIG. 7 is a top plan view similar to FIG. 1 depicting the ramp in the position illustrated in FIG. 5 with the toy vehicle passing underneath the ramp.
FIG. 8 is a sectional view taken along line 8—8 of FIG. 7.
FIG. 9 is a top plan view similar to FIG. 7 depicting a toy vehicle passing under the entrance side of the ramp.
FIG. 9A is a sectional view taken along lines 9A—9A of FIG. 9.
FIG. 9B is a developmental continuation of FIG. 9A depicting the pivoting of the ramp as the toy vehicle passes under and resets the ramp.

Reference is first made to FIGS. 1 through 3 wherein a pivotable ramp device, generally indicated as 15, constructed in accordance with a first embodiment of the invention for use in connection with a slotless track 16, is depicted. Slotless track 16 is constructed in a conventional manner and includes two sets of contact rails 17 and 17' which define first lane 18 and second lane 19 respectively. A slotless toy vehicle 20, such as a simulated racing car or the like, constructed in a conventional manner for use in connection with slotless track 16 is adapted to ride in either lane 18 or lane 19 and to be steered therebetween.

As is well known in the art, power is supplied to toy vehicle 20 through contact rails 17 or 17'. Of the three rails in each lane, one is a common rail and one is associated with each car. A voltage is selectively applied between the common rail and each car associated rail under the control of an operator-controlled controller (not shown), one controller being provided for each vehicle. A pair of brushes or the like on the under surface of the chasis of toy vehicle 20 press against the common rail and the car associated rail of contact rails 17 or 17' when toy vehicle 20 is in lane 18 or lane 19, respectively, and the voltage is applied to a motor (not shown) in the toy vehicle 20 coupled to the brushes for powering toy vehicle 20. The speed of toy vehicle 20 is determined by the magnitude of the voltage applied to the contact rails and hence to the motor in toy vehicle 20. As depicted in FIG. 1, toy vehicle 20 will travel in the forward direction, the direction of arrow A, when a voltage is applied to contact rails 17 in lane 18. It is noted that although a portion of track 16 is depicted in the drawings, track 16 is generally a continuous track formed from interlocking track sections.

As is well known in the art, slotless toy vehicles such as car 20 can freely change lanes by providing a steering mechanism (for lane selection) therein generally responsive to voltage polarity, which is controlled by the player. Accordingly, in a two lane slotless track game of the type depicted in FIG. 1, two toy vehicles 20 will be provided, one for each of the two players. As noted above, each player will have his own controller for controlling both the speed of his toy vehicle 20 and the lane 18 or 19 on which his toy vehicle is to ride. Since the slotless cars utilized on the slotless track can change lanes, where two cars are involed, the cars can selectively change lanes providing a more realistic simulation of actual racing track and highway conditions.

Pivotable ramp device 15 includes a base 21 having two substantially parallel legs 22 and 23 connected by an elevated platform 24. Legs 22 and 23 are connected by an elevated platform 24. Legs 22 and 23 of base 21 are adapted to engage on opposite sides 16*a* and 16*b* of track 16, and for this purpose are toed inwardly slightly. In this regard, track 16 includes side walls 16*c* and 16*d* which run along the lengthwise extent of sides 16*a* and 16*b* of track 16, in part for engagement by legs 22 and 23. Legs 22 and 23 include cutout portions 22*a* and 23*b* which are adapted to fit over projections 25 spaced along the lengthwise extent of sides 16*a* and 16*b* of track 16. It is noted however that the invention is not restricted to the method described herein for connecting base 21 to track 16.

Elevated platform 24 extends transversely across lanes 18 and 19 of track 16 and is elevated from track 16 a sufficient height to permit toy vehicle 20 to pass thereunder. Platform 24 includes two sets of spaced flanges 26 and 27 for allowing the pivotal coupling thereto of a ramp 28.

Ramp 28 includes a floor or riding surface 29 and side walls 30 and 31 on either side thereof. A cylindrical rod 32 is secured to the underside of floor 29 of ramp 28, defining an axis of pivoting. The ends 32*a* and 32*b* of rod 32 extend beyond the sides of ramp 28 and are adapted to be received in fingers 26 and 27 for pivotally coupling ramp 28 to base 21. Platform 24 includes projections 33 for preventing the transverse displacement of rod 32 with respect to fingers 26 and 27.

The pivotal coupling of ramp 28 to base 21 defines two sides of ramp 28. A first side is defined as entrance side 34 and the second side is defined as exit side 35. The end of entrance side 34 extends across both lanes 18 and 19 of track 16 for permitting a toy vehicle 20 in either lane 18 or 19 of ride up on ramp 28, as described below. Exit side 35 of ramp 28 is only one lane in width and accordingly only one toy vehicle 20 at a time can exit off of ramp 28. Thus, edge 29*a* of floor 29 and side wall 30 thereon are substantially linear. However, edge 29*b* and side wall 31 thereon are contoured as depicted in FIG. 1 so that the two lane width of entrance side 34 feeds into the one lane width of exit side 35.

Entrance side 34 of ramp 28 is sufficiently heavier than exit side 35 thereof that ramp 28 is normally inclined as depicted in FIG. 2, so that the end of entrance side 34 normally essentially contacts track 16 for permitting a toy vehicle in either lane 18 or 19 to ride up onto ramp 28. When a downward force is applied to exit side 35 of ramp 28 such as by a toy vehicle 20 being on exit side 35, ramp 28 will be caused to pivot about its axis defined by rod 32 and the end of exit side 35 will essentially contact track 16 for permitting a toy vehicle to ride off of exit side 35 onto track 16. As depicted in FIG. 1, a toy vehicle 20 entering ramp 28 from either lane 18 or 19 will exit off of ramp 29 onto lane 18 due to the single lane construction of exit side 35.

As aforenoted, since entrance side 34 of ramp 28 is heavier than the exit side thereof, ramp 28 will normally be inclined with entrance side 34 abutting track 16. In order to hold ramp 28 in the inverted incline position as depicted in FIG. 5, the ends 32*a* and 32*b* of cylindrical rods 32 each include a projection 36 which is adapted to be received in the associated notches 37 on the respective finger 26, 27. Referring to FIG. 4A, it is noted that projection 36 is not engaged in notch 37 when ramp 28 is in its normally inclined position as depicted in FIG. 2 and FIG. 4A. However, as depicted in 4B, when ramp 28 is pivoted so that it is inclined in the opposite direction than that depicted in FIG. 2. projection 36 will be captured in notch 37 on finger 26 and will gently hold ramp 28 in the inverted inclined position depicted in FIGS. 5 and 4B. It is noted that notches 37 are provided on each of the four fingers 26 so that the projections 36 will be captured in notches 37 regardless of the orientation of ramp 28 with respect to base 21. That is, since cylindrical rod 32 and hence ramp 28 can be selectively removed from fingers 26, reversed and reasserted in fingers 26, notches 37 are provided on each of the four fingers 26 to insure a notch will be available for capturing projection 36. As an alternative detent means for holding ramp 28 in the inverted inclined position, notches 37 can be omitted and fingers 26, 27 formed to be resilient, the resiliency pressing on projection 36 holding the ramp in position.

Reference is now made to FIGS. 1 through 9B in order to explain the use and operation of pivotable ramp device 15 when utilized in connection with a slotless track 16 and slotless toy vehicles 20. As depicted in FIGS. 1 and 2, a toy vehicle 20 approaching ramp 28 in the direction of arrow A, regardless of whether it is driving on lane 18 or 19, will ride up entrance side 34 of ramp 28 if ramp 28 is inclined so that entrance side 34 contacts track 16. If vehicle 20 is proceeding at a relatively slow speed, as vehicle 20 crosses over the axis of pivoting of ramp 28 defined by rod 32, ramp 28 will be caused to pivot as illustrated in FIG. 5 and the incline thereof will reverse so that entrance side 34 moves upward and exit side 35 contacts track 16. Toy vehicle 20 will ride down exit side 35 of ramp 28 and onto lane 18 of track 16 in the direction of arrow B depicted in FIG. 5. If, on the other hand, toy vehicle 20 rides up ramp 28 at a sufficiently fast speed, the downward force exerted on exit side 35 of ramp 28 will not be applied for a sufficiently long time so as to cause the full pivoting of ramp 28. Accordingly, as depicted in FIG. 6, vehicle 20 will jump or leap off of exit side 35 of ramp 28 in the direction of arrow E and will land on track 16 as depicted in phantom in FIG. 6 or crash if a square landing is not effected. Assuming vehicle 20 does not turn over or leave the track, vehicle 20 will then proceed on track 16 in the direction of arrow C.

Where ramp 28 is caused to pivot so that exit side 35 thereof contacts track 16, the detent mechanism defined by projections 36 and notches 37 will frictionally hold ramp 28 in its inverted inclined position as depicted in FIG. 5. A vehicle 20 approaching ramp 28 when it is in the inverted position depicted in FIG. 5 has two options. The car can be driven in lane 19 of track 16 as depicted in FIGS. 7 and 8 in the direction of arrow D. If vehicle 20 is proceeding in lane 19, vehicle 20 will pass under entrance side 34 of ramp 28 since it is raised and will thereafter pass under elevated platform 24. Due to the contour of ramp 28 wherein exit side 35 thereof is a single lane in width and only extends across lane 18 of track 16, vehicle 20 will continue in the direction of arrow D as depicted in FIGS. 7 and 8 without obstruction by pivotable ramp device 15.

Alternatively, as depicted in FIGS. 9 and 9A, where vehicle 20 is proceeding in lane 18 in the direction of arrow F, vehicle 20 will pass under entrance side 34 of ramp 28. The car will proceed in the direction of arrow F and the front end thereof will pass under elevated platform 24. However, due to the obstruction of lane 18 by exit side 35 of ramp 28, vehicle 20 will contact or crash into the under surface of exit side 35 thereby causing it to pivot upward in the direction of arrow G as depicted in FIG. B and accordingly projection 36 will be released from notch 37. Car 20 will then proceed in the direction of arrow H and ramp 28 will return to its normally inclined position as depicted in FIGS. 9A and 1.

It is noted that ramp 28 can be alternatively contoured so that exit side 35 thereof feeds onto lane 19 of track 16. Additionally, ramp 28 can be variously constructed so that for example, entrance side 34 of ramp 28 is a single lane in width and exit side 35 thereof extends across both lanes of track 16. The pivotable ramp device 15 as described above is particularly suited for use in competition between two players and their respective cars. Each player has the option to determine what will happen with respect to the ramp. For example, the player can decide whether to approach the ramp at a slow or fast speed in order to cause the pivoting thereof and the creation of an obstacle for his opponent's vehicle. However, where the ramp is inverted so that the exit side 35 contacts track 16, a player has the option to completely avoid the ramp or to reset the ramp by hitting the underside of exit side 35 of ramp 28. In this manner, the play value of the track game is substantially enhanced and a new and different skill factor is added to the conventional slotless track game.

Reference is now made to FIGS. 10 and 11 wherein a pivotable ramp device, generally indicated as 40, constructed in accordance with an alternative embodiment of the instant invention for use in connection with a slotted track 41 is depicted. Slotted track 41 includes two lanes 42 and 43 respectively. Each lane 42 and 43 includes a pair of contact rails 44 to which a voltage is applied for powering a slotted toy vehicle, better known as a slot car 45 in a conventional manner. Each lane 42 and 43 includes a centrally located slot 46 and slot car 45 includes a downwardly projecting rod or finger 47 adapted to receive in slot 46 for guiding slot car 45 around slotted track 41. In contradistinction to the slotless track 16 described above, slotted track 41 requires slot car 45 to remain on one of lanes 42 or 43. Accordingly, separate ramps 48 and 49 are provided for each of the lanes 42 and 43 respectively.

Pivotable ramp device 40 includes a base 50 which is constructed similarly to base 21 utilized in the slotless track pivotable ramp device described above. Base 50 includes legs 51 and 52 which are coupleable to slotted track 41 in the same manner discussed above with respect to slotless track 16. Base 50 includes an elevated platform 53 which couples leg 50 to leg 52. Platform 53 acts as the fulcrum for each of the ramps 48 and 49.

A cylindrical rod 54 defining an axis of pivoting is secured to the underside of each of the ramps 48 and 49 in a central portion thereof. The ends 54' and 54" of cylindrical rods 54 extend beyond the width of ramps 48 and 49. Platform 53 includes two pairs of offset fingers 55 for receiving cylindrical rods 54 therein. End 54" of each of the cylindrical rods 54 include a spur gear 56 and 57 respectively secured thereto. When cylindrical rods 54 are coupled in their respective pair of fingers 55, spur gears 56 and 57 mesh as best depicted in FIGS. 12A and 12B.

Each ramp 48, 49 includes an entrance side 58, 59, respectively and an exit side 68, 69 respectively. The incline of ramp 48 is opposite to that of ramp 49 as best viewed in FIG. 11 so that when entrance side 58 of ramp 48 contacts track 41, exit side 69 of ramp 49 contacts track 41. The meshing engagement of spur gears 56 and 57 cause ramps 48 and 49 to be simultaneously pivoted in opposite directions. Ends 54' of cylindrical rods 54 include projections 75 and fingers 55 include corresponding notches 76 for gently holding ramps 48 and 49 in either of the positions depicted in FIG. 10 and FIG. 12B. This insures that one of the entrance sides 58 and 59 of ramps 48 and 49 normally contact track 41.

When a slot car 45 is driving in the direction of arrow L along lane 42 of track 41, assuming entrance side 58 of ramp 48 is contacting track 41, it will ride up ramp 48. As slot car 45 passes over platform 53, a downward force will be exerted on the exit side 68 of ramp 48 in the direction of arrow M and accordingly ramp 48 will be caused to pivot in the direction of arrow M. The orientation of ramps 48 and 49 and their respective spur gears 56 and 57 is illustrated in FIG. 12A. As ramp 48 moves in the direction of arrow M, the meshing gear arrangement of spur gears 56 and 57 will cause ramp 49 to pivot in the opposite direction in the direction of arrow N. The orientation of ramps 48 and 49 and the meshing engagement of spur gears 56 and 57 after ramps 48 and 49 have been simultaneously pivoted is depicted in FIG. 12B. Arrows P and Q indicate the direction of rotation of gears 56 and 57 respectively as ramp 48 is caused to pivot in the direction of arrow M.

When ramps 48 and 49 are in the orientation depicted in FIGS. 10 and 11, a car approaching ramp 49 along lane 43 will pass under entrance side 59 thereof and will impact the under surface of exit side 69 thereof. Accordingly, in the same manner that a slot car 45 on ramp 48 causes the ramp to pivot in the direction of arrow M, a slot car 45 passing under entrance side 59 of ramp 49 and contacting exit side 69 thereof will cause a similar pivoting of ramp 48 in the direction of arrow M and ramp 49 in the direction of arrow M due to the meshing spur gear arrangement thereon, momentum carrying the assembly to the second rest position.

Pivotable ramp device 40 for use in connection with a two lane slotted track 41 is also particularly suited for use in competition between two players and their respective slot cars riding in their respective lanes 42 and 43. The pivotable ramp device enhances the play value of a slotted track game by creating obstacles and by adding a new and different skill factor to the playing of a slotted track game.

In accordance with the instant invention, alternative pivotable ramp devices are provided for both slotless and slotted track games which enhance the play value thereof. The devices are easily adaptable for use with any specific type of track game and can accordingly be sold together with a complete track game or as an add-on or accessory for track games.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A pivotable ramp device for use in a track game having at least one toy vehicle and a track having at least two lanes on which said toy vehicle can ride, comprising a base which is selectively coupleable to a position along said track, said base being formed to define an axis of pivoting extending transversely across said at least two lanes of said track and spaced above said track a sufficient height to permit the passage of said toy vehicle thereunder, and a ramp pivotally coupled to said base at said axis of pivoting, said axis defining two sides of said ramp, a first of said sides being an entrance side and a second of said sides being an exit side, the width of the end of said entrance side extending across said at least two lanes and the width of the end of said exit side extending across only one of said lanes, said ramp being pivotally displaceable between a first position where the end of said entrance side essentially contacts said track for permitting a toy vehicle in either of said lanes to ride up said ramp and a second position where the end of said exit side essentially contacts the track for permitting the toy vehicle to ride down said ramp and onto said only one lane of said track across which said exit side extends.

2. The device as claimed in claim 1, wherein said ramp is dimensioned to permit a toy vehicle in the other of said lanes to pass under said ramp axis and past said exit side without engaging said ramp when said ramp is in said second position.

3. The device as claimed in claim 2, wherein said ramp includes a floor and side walls secured to both sides of said floor substantially along the lengthwise extent thereof.

4. The device as claimed in claim 1, wherein said entrance side of said ramp is heavier than said exit side whereby said ramp is normally biased in said first position.

5. The device as claimed in claim 4, including holding means for releasably holding said ramp in said second position, whereby a vehicle in said one lane passes under said axis and engages the underside of said ramp to release said holding means to return said ramp to said first position when said ramp is in said second position.

6. The device as claimed in claim 5, wherein said ramp includes pivot means pivotably coupleable with said base at said axis, said holding means including detent means for releasably holding said ramp in said second position.

7. The device as claimed in claim 6, wherein said detent means includes a projection on said pivot means, said base including pivot support means for cooperating with said projection when said ramp is in said second position so that said ramp is releasably held in said second position.

8. The device as claimed in claim 4, wherein said ramp is pivotally coupled to said base so that a fast moving toy vehicle riding on said exit side of said ramp does not remain on said exit side a sufficient time to permit said ramp to reach said second position, thereby said ramp returns to said first position.

9. The device as claimed in claim 1, wherein said ramp is pivotally coupled to said base so that a slow moving toy vehicle riding on said exit side of said ramp causes said ramp to pivot into said second position.

10. The device as claimed in claim 1, 2, 6, 7, 3, 4, 5, 9 or 8, wherein said track is slotless, said toy vehicle being adapted for riding on said slotless track so that a user of said track game can selectively remotely control the lane on which said toy vehicle rides.

11. The device as claimed in claim 7, wherein said pivot support means includes at least two resilient fingers at said axis, said pivot means being pivotably coupleable intermediate said resilient fingers.

12. A pivotable ramp device for use in a track game having at least one toy vehicle and a track on which said toy vehicle can ride, comprising a base which is selectively coupleable to a position along said track, said base being formed to define an axis of pivoting extending transversely across said track and spaced above said track a sufficient height to permit the passage of said toy vehicle thereunder, ramp means pivotally coupled to said base at said axis of pivoting, said axis defining two sides of said ramp means, a first of said sides being an entrance side and second of said sides being an exit side, said ramp means being pivotally displaceable between a first position where the end of said entrance side essentially contacts said track for permitting a toy vehicle to ride up said ramp means and a second position where the end of said exit side essentially contacts the track for permitting said toy vehicle to ride down said ramp means and onto said track, and holding means for releasably holding said ramp means in said second position whereby a vehicle riding in one of said lane passes under said axis and engages the underside of said ramp means to release said holding means to pivot said ramp means to said first position when said ramp means is in said second position.

13. The device as claimed in claim 12, wherein said ramp means includes pivot means pivotably coupleable with said base at said axis, said holding means including detent means on said pivot means for releasably holding said ramp means in said second position.

14. The device as claimed in claim 13, wherein said detent means includes a projection on said pivot means, said base including pivot support means for cooperating with said projection, said base further including pivot support means for cooperating with said projection when said ramp means is in said second position so that said ramp means is releasably held in said second position.

15. The device as claimed in claim 14, wherein said pivot support means includes at least two resilient fingers at said axis, said pivot means being pivotably coupleable intermediate said resilient fingers, said projection cooperating with one of said resilient fingers to hold said ramp means in said second position.

16. The device as claimed in claims 11, 12, 13, 14 or 15, wherein said track is slotless and includes at least two lanes, said toy vehicle being adapted for riding on said slotless track so that a user of said track game can selectively remotely control the lane on which said toy vehicle rides.

* * * * *